United States Patent [19]

Pearson

[11] 4,007,498

[45] Feb. 15, 1977

[54] TOILET VENTILATOR INCLUDING OVERFLOW-RESPONSIVE SENSOR

[76] Inventor: Raymond H. Pearson, 627 Sherwood Drive, Richardson, Tex. 75080

[22] Filed: Jan. 5, 1976

[21] Appl. No.: 646,570

[52] U.S. Cl. ..... 4/213; 4/218

[51] Int. Cl.[2] ..... E03D 9/04; A47K 13/00

[58] Field of Search ..... 4/211, 209, 213, 217, 4/218, 67 R, DIG. 3, 100

[56] References Cited

UNITED STATES PATENTS

| | | | |
|---|---|---|---|
| 1,342,716 | 6/1920 | Johnston | 4/213 |
| 2,056,087 | 9/1936 | Andrews | 4/67 R |
| 2,061,310 | 11/1936 | Kleiser, Jr. | 4/67 R |
| 2,100,962 | 11/1937 | Juntunen | 4/213 |
| 2,105,794 | 1/1938 | Norris | 4/213 |
| 2,279,789 | 4/1942 | Jantzen | 4/213 |
| 2,778,033 | 1/1957 | Majauskas | 4/213 |
| 2,985,890 | 5/1961 | Baither | 4/213 |
| 3,087,168 | 4/1963 | Huso | 4/213 |
| 3,102,275 | 9/1963 | Raymond | 4/213 |
| 3,192,539 | 7/1965 | Martz | 4/218 |
| 3,495,282 | 2/1970 | Taggart | 4/213 |

*Primary Examiner*—Henry K. Artis

[57] ABSTRACT

A ventilator for toilets is disclosed which includes an air duct to receive and remove the odorous air, an air suction device to establish the odorous air flow, a control for initiating and terminating the odorous air flow, and a sensor responsive to the presence of water in the overflow duct, so as to terminate the air flow at the moment the toilet is flushed.

1 Claim, 2 Drawing Figures

TOILET VENTILATOR INCLUDING OVERFLOW-RESPONSIVE SENSOR

BACKGROUND OF THE INVENTION

1. Field of the Invention

This invention relates to a ventilator system for removing odorous air from toilet bowls, and more particularly to the type of toilet ventilators which include an air duct in communication with odorous air within the toilet, an air suction device, and automatic electrical control for terminating the ventilation when the toilet is flushed.

2. Description of the Prior Art

In addition to applicants pending applications Ser. Nos. 434,519, 496,954, and 540,538, others have disclosed toilet ventilators which include automatic controls for terminating ventilation when the toilet is flushed. The following patents are illustrative: U.S. Pat. Nos. 1,342,716, and 2,881,450.

U.S. Pat. No. 1,342,716 teaches a normally open switch which is automatically closed when the toilet seat is occupied, initiating the ventilator. A special linkage engages the ball cock float within the water tank when the water level falls a predetermined amount after the toilet is flushed. This causes the switch to open, terminating the ventilation.

U.S. Pat. No. 2,881,450 teaches a switch which is operated by an auxiliary float which senses the water level within the water tank. When the toilet is flushed, the water level falls, and the switch changes states at a predetermined water level, terminating the ventilation.

3. Advantages Over the Prior Art

A problem develops when the above methods of control are employed in toilet ventilators of the preferred type in which the water tank air pressure is reduced below atmospheric pressure, by means of an air suction device, so as to cause odorous air to flow from the toilet bowl via the water tank overflow duct. With the float operated switches above, there is necessarily a time delay between the flushing of the toilet and the termination of ventilation, because the water level must fall in order for the float to operate the switch. The air suction remains applied during this interval, and retards the normal rapid flushing cycle of the toilet, inasmuch as the air suction subtracts from the water head in the water tank. The present invention eliminates this time lag, and the resulting problem by means of a sensor which is responsive to water in the overflow duct of the water tank, at the moment the toilet is flushed, whereby ventilation is terminated at this same moment. The invention is suitable for use with all known types of electrically controlled toilet ventilators. The invention allows the use of large air flow, and low air pressure, without causing flushing retardation.

SUMMARY OF THE INVENTION

It is an object of this invention to provide an improved ventilator for toilets.

It is another object of this invention to provide immediate automatic termination of the ventilation when the toilet is flushed, in a manner which insures that the normal rapid flushing cycle of the toilet will not be retarded.

It is still another object of this invention to provide for the immediate automatic termination of the toilet ventilation by a means which is responsive to the flooding of the overflow duct when the toilet is flushed.

BRIEF DESCRIPTION OF THE DRAWINGS

With the foregoing objects and features in view, and such other objects and features which may become apparent as this specification proceeds, the invention will be understood from the following description, taken in conjunction with the accompanying drawings, in which like characters of reference are used to designate like parts, and in which.

DESCRIPTION OF THE PREFERRED EMBODIMENTS

Figure 1:
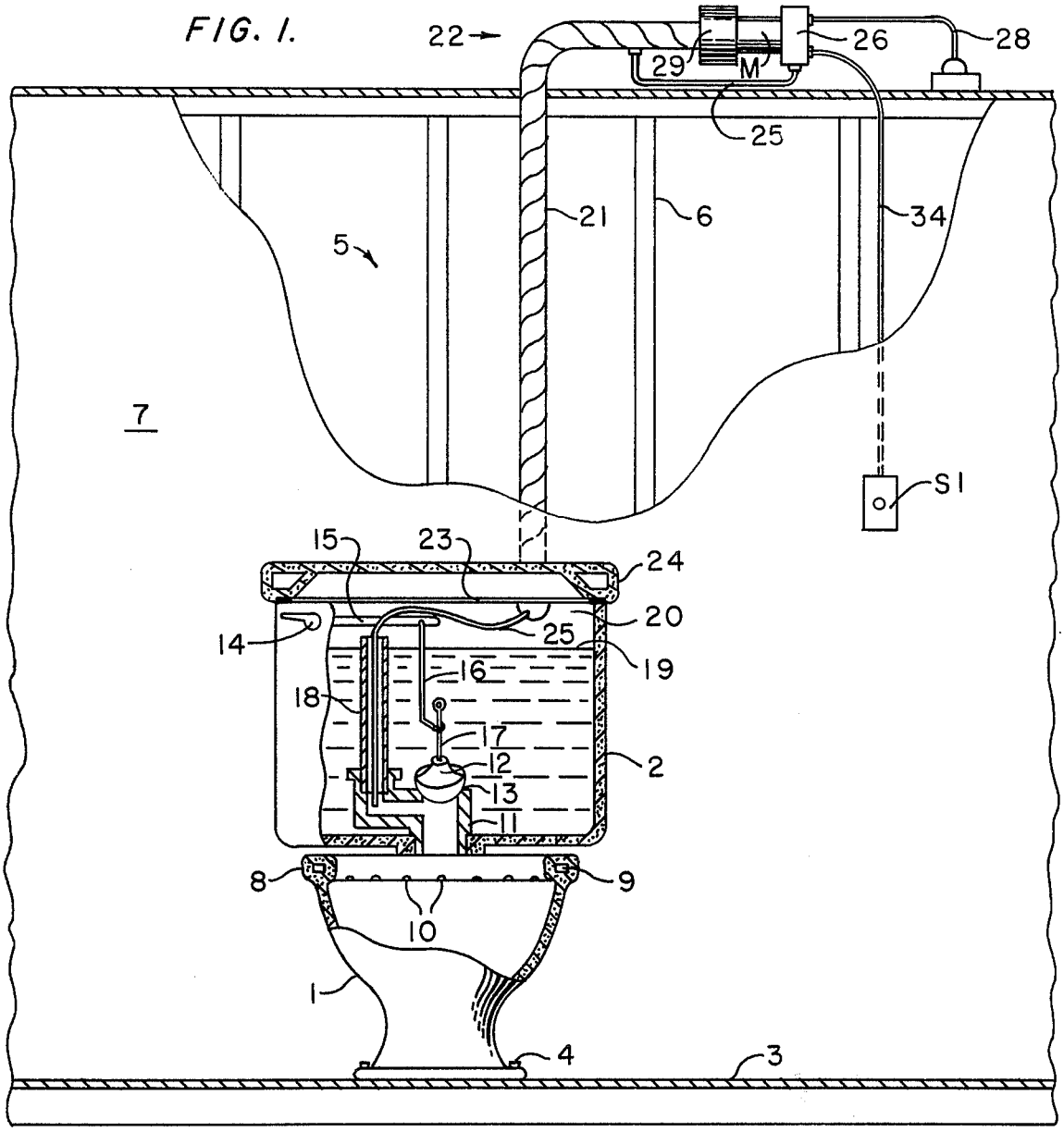
FIG. 1 is a front elevation view, shown partially in section, of a toilet equipped with the preferred ventilator and located adjacent to a typical bathroom wall, showing typical toilet detail together with detail of the ventilator including a small tube run into the overflow duct and extending to the electronics package.

Referring to the drawings in detail, and particularly FIG. 1, there is illustrated a toilet ventilator which is adapted to a conventional water closet including a toilet bowl 1 and water tank 2. The toilet bowl 1 is conventionally bolted to the bathroom floor 3 by bolts 4. A hollow bathroom wall 5, comprised of studs 6 and wall board 7, is shown behind the water closet. The top of the toilet bowl 1 includes a hollow rim 8 which defines a flush-water distribution channel 9, having water distribution holes 10 around the bottom edge. The water tank 2 is usually seated on the rear of the toilet bowl 1, or integral therewith, and is connected by means of a water discharge conduit 11 to a mating aperture (not shown) in the hollow rim 8. Some of the customary internal water tank hardware is shown including a tank ball flushing valve 12, which is shown in the normally closed position seated on the tank ball valve seat 13 at the upper terminus of the water discharge conduit 11. The tank ball 12 is adapted in the conventional manner to be lifted upon manual operation of the flushing mechanism comprised of a flushing handle 14, lever 15, linkage 16, and rod 17, whereupon water flows from the tank 2, through the water discharge conduit 11, into the water distribution channel 9, and out through the water distribution holes 10 so as to flush the toilet bowl 1. Other types of flushing valves, in lieu of the tank ball 12, are suitable also. An overflow duct 18 is connected into the water discharge conduit 11, or integral therewith, at a point beneath the tank ball 12. It will be understood that the water tank 2 also includes the usual inlet water pipe and automatic tank filling valve or ballcock (not shown) so as to refill the water tank 2 to a predetermined water level 19 after each flushing cycle. The water level 19 is in all cases below the upper terminus of the overflow duct 18. An air space 20 is always provided above the water line 19.

The preferred embodiment of the toilet ventilator includes an air duct 21, passing through the wall 5 behind the water closet, communicatively connected into the air space 20, and an air suction device 22, which is usually an electric blower installed in the attic or beneath the floor. When the ventilator is initiated, odorous air flows in seriatim from the toilet bowl 1, through the water distribution holes 10, through the water distribution channel 11, through the overflow duct 18, through the air space 20, through the air duct 21, and is discharged into the atmosphere by the air suction device 22. A seal 23 is usually provided between the upper rim of the water tank 2 and the water tank cover 24, so as to effect a more efficient flow of air through the toilet bowl 1. An electrical switch S1 is preferably mounted in the bathroom wall 5, for the purpose of initiating the ventilator.

It will be understood that the preferred embodiment reduces the air pressure of the water tank air space 20, causing the aforementioned odorous air flow. The pressure of the air space 20 is commonly reduced by 1 to 2 inches of water below atmospheric pressure when the ventilator is in use. When the toilet is flushed, water immediately floods the overflow duct 18, effectively blocking the flow of odorous air through it. At this time the pressure of the air space 20 falls to that of the air suction device intake side, which is commonly up to 4 inches of water below atmospheric pressure. It will be appreciated that the water head in the water tank 2 is normally only about eight to ten inches, and the sudden decrease in air pressure subtracts appreciably from this water head, retarding the gravity flow of water from the tank 2 into the bowl 1. The retarded flushing cycle is unsanitary, and a nuisance. As a remedy, I have invented the ventilator system which includes a sensor responsive to the rise of water in the overflow duct 18, automatically terminating the ventilation at the moment the toilet is flushed. With this invention, large air suctions may be employed for effective odor control, while effecting a normal rapid flushing cycle.

In the preferred embodiment, a small flexible tube 25, such as PVC or neoprene, is run into the overflow duct 18. It should preferably extend near to the bottom of the overflow duct 18. It should be small enough in diameter so as not to appreciably obstruct the flow of water through the overflow duct 18. The tube 25 passes into the air duct 21, emerging near the air suction device 22, and enters the electronic control package 26.

Figure 2:
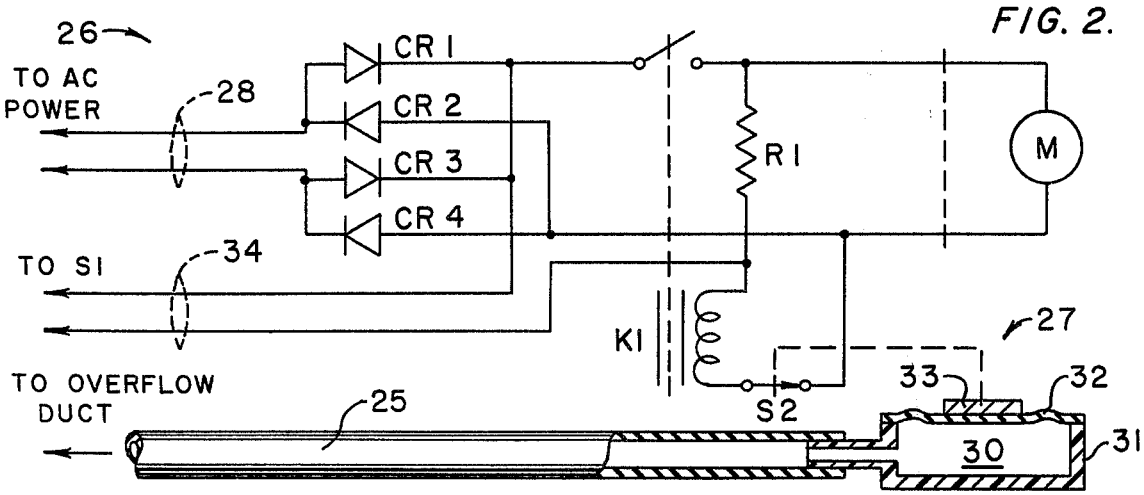
FIG. 2 is partially a schematic diagram and partially a diagrammatic view showing an electrical circuit and sensor which is suitable for this invention.

FIG. 2 portrays a schematic diagram of the electronics package 26, together with a diagrammatic view of the sensor 27. The electronics package 26 connects to any suitable power source, normally 120 volts 60 Hertz, by means of a cable 28. Rectifiers CR1, CR2, CR3, and CR4 provide direct current for a small high-speed motor M. The rectifiers may be omitted if an alternating current motor is employed. A normally-open electrical switch S1 is provided conveniently near to toilet, and connects to the electronics package 26 by means of a cable 34. The switch S1 has momentary contacts, and ideally a push button. When the switch S1 is momentarily closed, the relay K1 latches closed through a resistor R1, and the motor M starts, powering the air suction device 22, usually including a centrifugal blower 29. The flow of odorous air is thus established. When the toilet is flushed, water immediately floods the overflow duct 18. This water also attempts to enter the small tube 25, but cannot appreciably do so because the other end of the tube 25 is connected into a sealed cavity 30. The cavity 30 is contained by a sealed housing 31, and a flexible diaphragm 32. A circular piston 33 stiffens the middle of the diaphragm 32, and is mechanically linked to a second electrical switch S2, which is a normally-closed, momentary-contact type. Because one end of the tube 25 is sealed off by the cavity 30, as the water enters the tube 25 within the overflow duct 18, the air pressure within the tube 25, and therefore within the cavity 30, immediately rises nearly to the hydrostatic pressure of the water standing in the overflow duct 18. This is a useable pressure, and it causes the diaphragm 32 and piston 33 to open the electrical switch S2, unlatching the relay K1, terminating the ventilator. After the flushing cycle, the tank ball 12 closes, and water immediately empties from the overflow duct 18. At this time switch S2 again closes, and the cycle is repeatable. The electronic circuit described above is by no means exhaustive, and many other feasible circuits may be designed by those skilled in the art.

In the event that the air suction device intake pressure is more than four inches of water below atmospheric pressure, usually not the case, a modification is recommended. A second small tube (not shown) may be connected into the transducer housing 31. A small orifice (not shown) connects the second small tube into the cavity 30. The other end of the tube is run into the water tank air space 20. Thus the air pressure of the cavity 30 slowly equalizes to that of the water tank air space 20. This improves the magnitude of the pressure pulse appearing in the cavity 30 as the overflow duct 18 floods when the toilet is flushed.

It will be apparent to those skilled in the art that the sensor 27 and tube 25 may be replaced by a small float (not shown) extending down inside the overflow duct 18. In this event switch S2 is suitably fastened to the overflow duct 18, cover 24, or water tank 2 as desired. When the toilet is flushed, water floods the overflow duct 18 as before, and the small float (not shown) opens the switch S2, terminating the ventilator as before. Numerous other types of sensors may be employed in lieu of the preferred sensor 27 if so desired. The only basic requirement is that the sensor selected have at least one electrically sensible parameter which is a function of the water rise in the overflow duct 18 when the toilet is flushed.

For ventilators of the preferred type, in addition to terminating power to the air suction means 22, it is desirable that the air and electrical control means employed by capable of stopping the suction rapidly. Applicant has disclosed the use of brakes and valves for accomplishing this in his pending patent applications Ser. Nos. 496,954 and 540,538.

While the preferred embodiment is an especially good toilet ventilator, it is recognized that the invention disclosed herein is suitable for use with all known electrically controlled toilet ventilators, including those connected directly into the toilet bowl 1, those connected directly into the overflow duct 18, and toilet-mounted deodorizers, all of which are described in the art. The invention as disclosed may be modified without departing from the principles and scope of the invention, and it is not desired to limit the invention to the exact construction shown and described herein.

What is claimed is:

1. A toilet deodorizing accessary, said toilet including a toilet bowl and water tank, said water tank including a flushing mechanism and overflow duct, said accessary comprising an air duct in communication with the odorous air within said toilet, air suction means having an intake side and a discharge side, said intake side communicatively connected to said air duct, control means operable to initiate air flow through said air duct, whereby odorous air may be drawn from said toilet, said control means also operable to terminate said air flow, said control means including sensing means responsive to the water rise within said overflow duct, said sensing means having at least one electrically sensible parameter which is a function of said water rise within said overflow duct when said toilet is flushed, whereby said air flow may be terminated in response to said water rise in said overflow duct when said toilet is flushed.

* * * * *